US010863768B2

(12) United States Patent
Besso et al.

(10) Patent No.: US 10,863,768 B2
(45) Date of Patent: Dec. 15, 2020

(54) AEROSOL GENERATING ARTICLE HAVING REMOVABLE TIPPING WRAPPER PORTION WITH TEAR TAB

(71) Applicant: PHILIP MORRIS PRODUCTS S.A., Neuchatel (CH)

(72) Inventors: Clement Besso, Neuchatel (CH); Diogo Meira Brandao, Neuchatel (CH); Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 16 days.

(21) Appl. No.: 16/085,119

(22) PCT Filed: Mar. 23, 2017

(86) PCT No.: PCT/EP2017/057017
§ 371 (c)(1),
(2) Date: Sep. 14, 2018

(87) PCT Pub. No.: WO2017/162838
PCT Pub. Date: Sep. 28, 2017

(65) Prior Publication Data

US 2019/0069596 A1 Mar. 7, 2019

(30) Foreign Application Priority Data

Mar. 24, 2016 (EP) ..... 16162181

(51) Int. Cl.
*A24D 1/02* (2006.01)
*A24D 1/04* (2006.01)

(52) U.S. Cl.
CPC ..... *A24D 1/02* (2013.01); *A24D 1/042* (2013.01)

(58) Field of Classification Search
CPC ..... A24D 1/02
(Continued)

(56) References Cited

U.S. PATENT DOCUMENTS 4,727,892 A * 3/1988 Abdelgawad ..... A24D 3/041 131/198.2
2007/0095357 A1 5/2007 Besso
(Continued)

FOREIGN PATENT DOCUMENTS

CN 102227174 10/2011
CN 203446522 2/2014
(Continued)

OTHER PUBLICATIONS

European Extended Search Report for Application No. 16162181.8 dated Sep. 2, 2016 (6 pages).
(Continued)

*Primary Examiner* — Eric Yaary
*Assistant Examiner* — Jennifer A Kessie
(74) *Attorney, Agent, or Firm* — Mueting Raasch Group

(57) ABSTRACT

An aerosol generating article (10) comprises an aerosol generating substrate (12), a mouthpiece (14) in axial alignment with the aerosol generating substrate (12), and a tipping wrapper (20). The tipping wrapper (20) comprises a first weakening line (22) extending circumferentially around at least a portion of the tipping wrapper; a removable tipping wrapper portion (26) extending downstream from the at least one weakening line (22); an upstream tipping wrapper portion (24) extending upstream from the first weakening line; and a longitudinal edge (28) extending along the outer surface of the mouthpiece. The longitudinal edge (28) comprises a tipping wrapper projection (32) downstream of the at least one weakening line (22) and a first straight line portion (30) extending upstream of the tipping wrapper projection (32), wherein the tipping wrapper projection (32) comprises a first curved transition portion (38) connecting the first straight line portion (30) to the remainder of the
(Continued)

tipping wrapper projection and wherein the first curved transition portion (30) follows a convex curve.

14 Claims, 2 Drawing Sheets

(58) Field of Classification Search
USPC ..... 131/365
See application file for complete search history.

(56) References Cited

U.S. PATENT DOCUMENTS

| | | | | |
|---|---|---|---|---|
| 2008/0029111 | A1 | 2/2008 | Dube | |
| 2017/0231269 | A1* | 8/2017 | Besso | A24D 1/02 131/337 |

FOREIGN PATENT DOCUMENTS

| | | | | |
|---|---|---|---|---|
| EP | 2002737 | | 12/2008 | |
| EP | 2046153 | | 7/2012 | |
| EP | 2888958 | | 7/2015 | |
| WO | WO 2007/051163 | | 5/2007 | |
| WO | WO 2010/051076 | | 5/2010 | |
| WO | WO 2016/016252 | | 2/2016 | |
| WO | WO-2016016252 | A1 * | 2/2016 | A24D 1/02 |
| WO | WO 2016/188649 | | 12/2016 | |

OTHER PUBLICATIONS

PCT Search Report and Written Opinion for PCT/EP2017/057017 dated May 29, 2017 (8 pages).
Office Action issued in Europe for Application No. 17713286.7 dated Oct. 25, 2019 (4 pages).
Office Action issued in China for Application No. 201780015277.3 dated Sep. 24, 2020 (20 pages). English translation included.

* cited by examiner

AEROSOL GENERATING ARTICLE HAVING REMOVABLE TIPPING WRAPPER PORTION WITH TEAR TAB

This application is a U.S. National Stage Application of International Application No. PCT/EP2017/057017 filed Mar. 23, 2017, which was published in English on Sep. 28, 2017, as International Publication No. WO 2017/162838 A1. International Application No. PCT/EP2017/057017 claims priority to European Application No. 16162181.8 filed Mar. 24, 2016.

The present invention relates to an aerosol generating article comprising a removable tipping wrapper portion having a novel tear tab arrangement.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper that normally circumscribes the entire length of the filter and an adjacent portion of the wrapped tobacco rod. A conventional filter cigarette is typically smoked by lighting the end of the cigarette opposite the mouthpiece so that the tobacco rod burns.

A number of aerosol generating articles in which tobacco is heated rather than combusted have also been proposed in the art. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the aerosol generating article. As the released compounds cool they condense to form an aerosol that is inhaled by the consumer. Also known are aerosol generating articles in which a nicotine-containing aerosol is generated from a tobacco material, tobacco extract, or other nicotine source, without combustion, and in some cases without heating, for example through a chemical reaction.

It is known to provide an aerosol generating article having a tipping wrapper with at least one removable portion, wherein the removal of the tipping wrapper portion provides an effect on the smoking experience. For example, EP-A-2 046 153 describes a filter cigarette having a removable outer layer of tipping material, wherein the outer layer of tipping material can be removed by the consumer during or after smoking to provide a different sensory experience.

However, it can be difficult for the consumer to effectively separate the removable portion of the tipping wrapper from the remainder of the tipping wrapper in order to remove it from the mouthpiece. It is known to provide one or more perforation lines in the tipping wrapper in order to assist the tearing of the tipping wrapper, but this will only be effective if the consumer is able to conveniently tear along the perforation lines. This may be difficult in view of the small size of the smoking articles and the tight wrapping of the tipping wrapper around the aerosol generating article. In many cases, the tipping wrapper will tear along a different line than the perforation line and so the removable tipping wrapper portion does not come away as a whole piece but may instead need to be removed in several pieces.

It would be desirable to provide an aerosol generating article that includes a tipping wrapper with a novel arrangement for facilitating removal of a portion of the tipping wrapper. It would be particularly desirable to provide such an aerosol generating article that can be readily manufactured using existing high speed manufacturing techniques with minimal modification.

According to the present invention there is provided an aerosol generating substrate; a mouthpiece in axial alignment with the aerosol generating substrate; and a tipping wrapper wrapped around the mouthpiece and at least a portion of the aerosol generating substrate. The tipping wrapper comprises: a first weakening line extending around at least a portion of the tipping wrapper; a removable tipping wrapper portion extending downstream from the at least one weakening line; an upstream tipping wrapper portion extending upstream from the first weakening line, wherein the upstream tipping wrapper portion is attached to a downstream portion of the aerosol generating substrate and an upstream portion of the mouthpiece; and a longitudinal edge extending along the outer surface of the mouthpiece. The longitudinal edge comprises a tipping wrapper projection downstream of the at least one weakening line on the removable tipping wrapper portion and a first straight line portion extending upstream from the tipping wrapper projection. The tipping wrapper projection comprises a first curved transition portion connecting the first straight line portion of the longitudinal edge to the remainder of the tipping wrapper projection, wherein the first curved transition portion follows a convex curve.

As used herein, the term "aerosol generating substrate" describes a substrate capable of releasing, upon heating (including combustion), volatile compounds, which can form an aerosol. The aerosol generated from aerosol generating substrates may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" describe the relative positions of elements, or portions of elements, of the aerosol generating article in relation to the direction in which a consumer draws on the aerosol generating article during use thereof. Aerosol generating articles as described herein comprise a downstream end (that is, the mouth end) and an opposed upstream end. In use, a consumer draws on the downstream end of the aerosol generating article. The downstream end is downstream of the upstream end, which may also be described as the distal end. The mouthpiece is downstream of the aerosol generating substrate.

As used herein, the term "longitudinal" refers to the direction corresponding to the longitudinal axis of the aerosol generating article or mouthpiece. The "longitudinal edge" of the tipping wrapper refers to the free edge of the tipping wrapper that extends in a longitudinal direction between the ends of the mouthpiece, along the outer surface of the mouthpiece.

As used herein, the term "tipping wrapper projection" refers to the portion of the longitudinal edge which projects away from the first straight line portion in a circumferential direction to define a tear tab at the edge of the tipping wrapper. Typically, the tipping wrapper projection will project entirely beyond the first straight line portion, such that the tipping wrapper projection projects away from the tipping wrapper in a circumferential direction. However, in certain embodiments at least a portion of the tipping wrapper projection, for example in the region immediately adjacent the first straight line portion, may project inwardly towards the tipping wrapper in a circumferential direction.

As used herein, the term "first curved transition portion" refers to the portion of the tipping wrapper projection connecting the first straight line portion to the remainder of the tipping wrapper projection. The upstream end of the first curved transition portion corresponds to the point at which the longitudinal edge begins to curve away from the first straight line portion, as determined by the naked eye. The downstream end of the first curved transition portion corresponds to the point at which the curvature of the tipping wrapper projection changes direction from the convex curvature of the first curved transition portion, as determined by the naked eye. For example, where the tipping wrapper projection is a continuous curve, the downstream end of the first curved transition portion corresponds to the inflection point at which the curvature of the tipping wrapper projection changes from convex to concave. In other embodiments, the downstream end of the first curved transition portion may correspond to a corner where the convex curvature of the first curved transition portion changes to a linear portion.

The term "convex" is used herein to describe a portion of the tipping wrapper projection curve that has a curve with a gradient that increases as the curve moves away from the tipping wrapper in a circumferential direction. In the case of the first curved transition portion, the gradient therefore increases moving along the curve in the downstream direction. All tangents to the convex curve lie below the curve when the tipping wrapper is viewed in a flat state with the longitudinal edge incorporating the tipping wrapper projection along the top. A "convex" curve may also be described as "concave upward" or "convex downward".

The term "concave" is conversely used herein to describe a curve that has the opposite curvature to a "convex" curve and which therefore has a gradient that decreases with increasing circumferential distance from the tipping wrapper. For a concave curve, all tangents to the curve lie above the curve when the tipping wrapper is viewed in a flat state with the longitudinal edge incorporating the tipping wrapper projection along the top. A "concave" curve may also be described as "concave downward" or "convex upward".

In the tipping wrapper of the aerosol generating article of the present invention, the first curved transition portion of the tipping wrapper projection "follows a convex curve". This is intended to cover embodiments in which the first curved transition portion is convexly curved as well as embodiments in which the first curved transition portion approximates a convex curve.

The "first straight line portion" of the longitudinal edge of the tipping wrapper extends in a straight line without curvature, substantially parallel to the longitudinal axis of the aerosol generating article.

The tipping wrapper of aerosol generating articles of the present invention corresponds to the outer wrapper of the mouthpiece, which circumscribes the mouthpiece and the downstream end of the aerosol generating substrate. As described above, the tipping wrapper includes an upstream tipping wrapper portion which attaches the downstream end of the aerosol generating substrate to the upstream end of the mouthpiece and which is intended to stay in place on the aerosol generating article after the removal of the removable tipping wrapper portion. The tipping wrapper further includes a downstream, removable tipping wrapper portion. Initially, the upstream tipping wrapper portion and the removable tipping wrapper portion are connected along the first weakening line and the tipping wrapper can be torn by the consumer along the first weakening line in order to remove the removable tipping wrapper portion.

The aerosol generating articles of the present invention therefore provide a removable tipping wrapper portion that can be removed from the mouthpiece by the consumer, prior to smoking or during smoking, by breaking along the first weakening line in the tipping wrapper. The removal of at least a portion of the tipping wrapper of an aerosol generating article to expose a clean, underlying mouthpiece wrapper may advantageously improve hygiene levels for the consumer. This may be particularly beneficial, for example, where aerosol generating articles have been transported or stored individually, rather than within a container. Furthermore, a removable tipping wrapper portion may be used to provide the consumer with the ability to change the sensory experience obtained during smoking. For example, the mouthpiece may be provided with a flavourant or other additive that is released upon removal of the removable tipping wrapper portion. In another example, the mouthpiece may be provided with additional ventilation which is uncovered when the removable tipping wrapper portion is removed.

The tipping wrapper of aerosol generating articles according to the present invention is adapted such that a tipping wrapper projection is provided in the longitudinal edge to define a tear tab, which the consumer can grasp and pull to facilitate removal of the removable tipping wrapper portion from the mouthpiece. The tear tab defined by the tipping wrapper projection is preferably not adhered to the surface of the tipping wrapper, so that it can be readily grasped by the consumer.

The convex curvature of the first curved transition portion of the tipping wrapper projection, as described above, advantageously provides a gradual transition between the first straight line portion and the tipping wrapper projection and ensures that there are no sharp angles or corners in the region of the longitudinal edge where the tear tab meets the first straight line portion.

If a sharp angle or corner were to exist in this region of the longitudinal edge, a point of weakness may be created at the edge of the tipping wrapper, which could lead to undesired tearing of the tipping wrapper at this point. Conversely, in aerosol generating articles according to the present invention, the convex curvature of the first curved transition portion ensures that there should be no specific points of weakness introduced by the tipping wrapper projection, thereby minimising the risk of tearing of the tipping wrapper in the first curved transition portion. Instead, the curved shape advantageously enables the pulling force exerted by the consumer on the tear tab to be transferred more effectively to the first weakening line. The removable tipping wrapper portion can therefore be more easily removed in a single action by the consumer.

The tipping wrapper projection can be incorporated into the longitudinal edge of the tipping wrapper during production of the tipping wrappers, for example, during the cutting of individual tipping wrappers from a continuous sheet of tipping wrapper material. The modified tipping wrapper can then advantageously be wrapped around the aerosol generating article using existing apparatus and techniques, without the need for significant modification.

The radius of curvature of the first curved transition portion will determine the gradient of the convex curve and therefore how gradually the longitudinal edge of the tipping wrapper curves between the first straight line portion and the top of the tipping wrapper projection, wherein the "top"

refers to the point furthest from the first straight line portion in a circumferential direction. The greater the radius of curvature in the first curved transition portion, the more gradually the edge curves upwards away from the first straight line portion. Preferably, the radius of curvature is at least about 0.5 mm along the length of the first curved transition portion, more preferably at least about 1 mm, most preferably at least about 2 mm. A more gradual curvature, for example, with a radius of curvature of at least 0.5 mm further minimises the risk of the tipping wrapper tearing in the first curved transition portion.

As used herein, the "radius of curvature" refers to the radius of the circle that best fits the curve at any particular point along the first curved transition portion.

The radius of curvature may be substantially constant along the first curved transition portion, for example, where the first curved transition portion approximates an arc. Alternatively, the radius of curvature may vary along the first curved transition portion but preferably remains at or above 0.5 mm at all points along the length of the first curved transition portion.

The position of the tipping wrapper projection relative to the first weakening line may also be varied in order to minimise the risk of tearing of the tipping wrapper other than along the first weakening line. Preferably, the tipping wrapper projection is provided between about 0 mm and about 15 mm downstream of the first weakening line, more preferably between about 5 mm and about 10 mm. This corresponds to the distance between the first weakening line and the upstream end of the first curved transition portion (as defined above).

Preferably, the tipping wrapper projection extends between about 2.0 mm and about 5.0 mm beyond the first straight line portion, more preferably between about 2.5 mm and about 4.0 mm beyond the first straight line portion in the circumferential direction. This corresponds to the circumferential distance between the first straight line portion and the "top" of the tipping wrapper projection as defined above, which defines the height of the tear tab relative to the straight part of the longitudinal edge.

By providing the tear tab with a height of at least 2.0 mm, the tear tab is of a convenient size for the consumer to grasp. On the other hand, keeping the height of the tear tab less than or equal to 5.0 mm may be advantageous from a manufacturing point of view. Tear tabs having a greater height will typically protrude to a larger extent from the surface of the aerosol generating article and the tear tabs of adjacent aerosol generating articles may interfere with each other during processing of the assembled aerosol generating articles. This may in turn lead to obstruction of the flow of the aerosol generating articles through the high speed apparatus. Furthermore, it may become increasingly difficult to accurately cut tear tabs having a greater height into the tipping wrapper during manufacture, due to the challenges of running the cutting knife at the same speed as the drum carrying the tipping wrapper material.

Preferably, the tipping wrapper projection extends in the circumferential direction by a distance corresponding to between about 10 percent and about 20 percent of the outer circumference of the mouthpiece.

Preferably, the width of the tipping wrapper projection in the longitudinal direction is at least about 2.5 mm. Alternatively or in addition, the width of the tipping wrapper projection in the longitudinal direction is preferably less than 15 mm.

Preferably, the width of the tipping wrapper projection in the longitudinal direction corresponds to between about 10 percent and about 50 percent of the total width of the tipping wrapper in the longitudinal direction.

The "width" of the tipping wrapper projection corresponds to the maximum dimension of the tipping wrapper projection in the longitudinal direction. The width will be measured from the upstream end of the first curved transition portion, as defined above, to the downstream end of the tipping wrapper projection. The downstream end of the tipping wrapper projection may correspond to the downstream end of the removable tipping wrapper portion or may correspond to the point at which the tipping wrapper projection connects to a second straight line portion downstream of the tipping wrapper projection, as discussed below.

Preferably, the width of the first curved transition portion in the longitudinal direction corresponds to at least about 10 percent of the distance of the tipping wrapper projection from the first weakening line.

As discussed above, the first straight line portion of the longitudinal edge of the tipping wrapper extends upstream from the tipping wrapper projection. Typically, the first straight line portion of the longitudinal edge extends to the upstream end of the tipping wrapper. Preferably, the first weakening line is provided at a position along the first straight line portion such that at least a portion of the first straight line portion is provided downstream of the first weakening line. This downstream portion of the first weakening line therefore extends between the first weakening line and the tipping wrapper projection. In alternative embodiments, the first straight line portion may be provided entirely upstream of the first weakening line, such that the upstream end of the tipping wrapper projection substantially coincides with the position of the first weakening line. In such embodiments, the tear tab is provided immediately adjacent to the first weakening line.

The tipping wrapper projection may take a variety of suitable shapes downstream of the first curved transition portion. In certain preferred embodiments, the longitudinal edge of the tipping wrapper further comprises a second straight line portion extending downstream from the tipping wrapper projection to the downstream end of the removable tipping wrapper portion. The second straight line portion is typically at substantially the same circumferential position as the first straight line portion. In these embodiments, the tipping wrapper projection preferably further comprises a second curved transition portion connecting the second straight line portion of the longitudinal edge to the remainder of the tipping wrapper projection, wherein the second curved transition portion follows a convex curve.

The position of the upstream and downstream ends of the second curved transition portion can be determined in an analogous manner to the position of the downstream and upstream ends, respectively, of the first curved transition portion, as defined above.

Preferably, the tipping wrapper projection is substantially symmetric so that the first and second curved transition portions have substantially the same curvature and dimensions as each other.

The shape of the tipping wrapper projection between the first and second curved transition portions may vary. In some embodiments, the tipping wrapper projection may incorporate a linear portion between the first and second curved transition portions so that the top edge of the tear tab is substantially flat. In alternative embodiments, the tipping wrapper projection may incorporate a curved portion between the first and second curved transition portions, for example, to form an inverted U-shaped tear tab.

Preferably, the tipping wrapper projection is a substantially continuous, smooth curve. This means that the tipping wrapper projection is preferably substantially free from linear portions and angles or corners and provides a smooth, curved edge to the tear tab. For the purposes of the present invention, a "smooth" curve is one for which every point along the curve has a unique tangent line. Preferably, the tipping wrapper projection is a symmetric curve. Alternatively, the tipping wrapper projection may be an asymmetric curve.

In certain preferred embodiments, the tipping wrapper projection follows a concave curve between the first and second curved transition portions. At the downstream end of the first curved transition portion, corresponding to a first inflection point, the curvature of the tipping wrapper projection therefore changes from convex to concave such that the tipping wrapper projection begins to curve back around towards the tipping wrapper. At a second inflection point, the curvature of the tipping wrapper projection will change back to convex and this corresponds to the upstream end of the second curved transition portion.

Preferably, the tipping wrapper projection follows a bell-shaped curve, preferably a symmetric bell-shaped curve. For example, in one particularly preferred embodiment, the tipping wrapper projection follows a normal or Gaussian-like curve. In alternative embodiments, the tipping wrapper projection may follow an asymmetric bell-shaped curve.

In alternative embodiments, the tipping wrapper projection may not include a second curved transition portion. For example, in certain preferred embodiments, the tipping wrapper projection comprises a linear portion downstream of the first curved transition portion, wherein the linear portion extends to the downstream edge of the removable tipping wrapper portion. The linear portion may be connected to the first curved transition portion at a sharp corner or vertex, or more preferably at a rounded or bevelled corner. In such embodiments, the tear tab may be elongate in shape, extending in the longitudinal direction along the removable tipping wrapper portion.

As described above, the tipping wrapper of the aerosol generating articles of the present invention comprises a removable tipping wrapper portion incorporating the tear tab. The removable tipping wrapper portion is defined downstream of the first weakening line. The upstream tipping wrapper portion, defined upstream of the first weakening line, is attached to a downstream portion of the aerosol generating substrate and an upstream portion of the mouthpiece.

The position of the first weakening line along the mouthpiece may be adjusted depending upon how much of the tipping wrapper is intended to be removed. Preferably, the first weakening line is positioned at least about 5 mm from the upstream end of the mouthpiece, in a longitudinal direction. This ensures that a sufficient portion of the tipping wrapper remains on the aerosol generating article to provide the upstream tipping wrapper portion. Alternatively or in addition, the first weakening line is preferably positioned no more than 15 mm from the upstream end of the mouthpiece.

Preferably, the first weakening line extends around at least 75 percent of the circumference of the mouthpiece, more preferably around at least 85 percent of the circumference. In certain preferred embodiments, the first weakening line extends around substantially the entire circumference of the mouthpiece.

The length of the removable tipping wrapper portion in the longitudinal direction of the aerosol generating article may also be adjusted depending, for example, upon the intended effect of the removal of a portion of the tipping wrapper.

In certain embodiments of the present invention, the removable tipping wrapper portion extends to the downstream end of the mouthpiece so that the entire tipping wrapper downstream of the first weakening line is removed to expose the underlying mouthpiece surface. This arrangement may be advantageous, for example, where the removable tipping wrapper portion is provided for the improvement of hygiene during smoking.

In alternative embodiments of the present invention, the tipping wrapper may further comprise a second weakening line spaced apart from the first weakening line in the downstream direction, wherein the removable tipping wrapper portion is defined between the first weakening line and the second weakening line. In such embodiments, the tipping wrapper preferably further comprises a downstream tipping wrapper portion extending downstream from the second weakening line and attached to a downstream portion of the mouthpiece. This arrangement may be preferable, for example, where a strip of the tipping wrapper is removable in order to expose an underlying additive or ventilation.

In embodiments incorporating a second weakening line, the tipping wrapper projection preferably includes a second curved transition portion, as described above, to ensure the desired tearing along both the first and second weakening lines. In addition, the longitudinal edge of the tipping wrapper projection preferably comprises a second straight line portion extending between the tipping wrapper projection and the second weakening line. The tipping wrapper projection is preferably positioned substantially centrally along the removable tipping wrapper portion, between the first and second weakening lines.

The first weakening line and the second weakening line (where present) may take any suitable form to provide a line of weakness in the tipping wrapper along which the tipping wrapper will preferentially tear. Preferably, each weakening line comprises multiple cuts spaced apart in a circumferential direction to form a row of perforations extending around the tipping wrapper. In such embodiments, the row of perforations preferably extends around substantially the entire circumference of the tipping wrapper. To aid the consumer in tearing the tipping wrapper along the row of perforations, the weakening line may comprise an elongate cut extending between an edge of the tipping wrapper at a tipping wrapper seam and the first perforation in the row of perforations.

Where a row perforations is provided, the row of perforations comprises uncut segments of tipping wrapper between consecutive perforations. The total length of the uncut segments preferably defines a percentage of hold of between about 15 percent and about 30 percent of the total length of the row of perforations, more preferably between about 18 percent and about 25 percent.

A "percentage of hold" for a row of perforations can be used as an indication of the strength of the row of perforations and is defined as:

$$\text{percentage of hold} = \frac{\text{total length of uncut segments}}{\text{total length of uncut segments} + \text{total length of perforations}} \times 100$$

wherein the length of each uncut segment is the shortest distance along the tipping wrapper between adjacent perforations, and wherein the length of each perforation is the length of a straight line drawn between the two circumferential extremities of the perforation. In the case of a circular perforation, the length of the perforation is the diameter of the circle.

A high percentage of hold therefore represents a row of perforations in which a large amount of uncut material remains between the perforations. A row of perforations that has a high percentage of hold will generally require more force to break the tipping wrapper along the row of perforations.

Advantageously, a percentage of hold of between 15 percent and 30 percent is large enough to prevent accidental breakage of the tipping wrapper along the row of perforations when the tipping wrapper is handled during manufacture of the smoking article, while remaining low enough so that only a moderate breaking force is required to intentionally break the wrapper along the row of perforations after the smoking article has been constructed. It has been found that the force required to break a wrapper along a row of perforations defining a percentage of hold within this range is largely independent of the basis weight of the sheet material used to form the tipping wrapper when comparing different sheet materials that are typically used to form wrappers for smoking articles.

The row of perforations may optionally be provided with one or more additional features as described in EP-A-2 888 958.

In any of the embodiments described above, the aerosol generating article may be free from adhesive between the removable tipping wrapper portion and the underlying mouthpiece portion, to facilitate removal of the removable tipping wrapper portion. Alternatively, the aerosol generating article may comprise a low-tack adhesive between the removable tipping wrapper portion and the underlying mouthpiece portion.

The tipping wrapper is preferably formed of a sheet of paper material, although other materials would also be suitable. Preferably, the tipping wrapper is formed of a sheet material having a basis weight of between about 35 grams per square metre and about 50 grams per square metre.

In aerosol generating articles according to the present invention, the removal of the removable tipping wrapper portion exposes the underlying mouthpiece or mouthpiece segment, which will typically be wrapped in one or more mouthpiece wrappers. In any of the embodiments described above, the mouthpiece may comprise a mouthpiece wrapper circumscribing one or more mouthpiece segments. For example, the mouthpiece may comprise a single segment of filter material and the mouthpiece wrapper may be an individual plug wrap circumscribing the single segment of filter material. Alternatively, the mouthpiece may comprise a plurality of segments of filter material and the mouthpiece wrapper may be a combining plug wrap circumscribing the plurality of segments of filter material. In such embodiments, each of the segments of filter material may be wrapped in an individual plug wrap underlying the combining plug wrap.

The mouthpiece wrapper may be formed from a porous material, such as a porous paper. However, the mouthpiece wrapper is preferably formed from a non-porous material, such as a non-porous paper or a polymeric material. The non-porous material may comprise an inherently non-porous material, or the non-porous material may comprise a porous substrate onto which a non-porous coating is applied. Preferably, the mouthpiece wrapper has a porosity of less than about 20 Coresta Units, more preferably less than about 10 Coresta Units, and more preferably less than about 5 Coresta Units, measured in accordance with the Coresta Recommended Method No. 40. Most preferably, the mouthpiece wrapper has a porosity of about zero Coresta Units. Suitable materials for forming the mouthpiece wrapper include cellulosic polymeric materials, starch-based polymeric materials, polyvinyl alcohol, cellophane, polylactide, and combinations thereof.

A coating may be applied to an outer surface of the mouthpiece wrapper to provide a moisture barrier that may minimise the risk of a consumer's lips or mouth wetting the mouthpiece wrapper and may therefore reduce the risk of a consumer's lips or mouth sticking the mouthpiece wrapper after the removable tipping wrapper portion has been removed. For example, a suitable lip-release lacquer may be applied to an outer surface of the mouthpiece wrapper, as known to the skilled person. The coating may be in addition to, or as an alternative to, a non-porous coating applied to the mouthpiece wrapper, as described above. In those embodiments in which the mouthpiece wrapper comprises a non-porous coating and a lip-release coating, both coatings may comprise the same coating material. Alternatively, the non-porous coating and the lip release coating may comprise different coating materials.

The mouthpiece wrapper may have a basis weight of less than about 90 grams per square metre. The mouthpiece wrapper preferably has a basis weight of more than about 20 grams per square metre.

In certain preferred embodiments, the mouthpiece wrapper comprises a plug wrap or combination of plug wraps having a basis weight of between about 50 grams per square metre and about 100 grams per square metre, more preferably between about 65 grams per square metre and about 85 grams per square metre and most preferably between about 60 grams per square metre and about 70 grams per square metre. By providing a plug wrap or combination of plug wraps having a basis weight within this range, a relatively stiff mouthpiece wrapper is obtained. This advantageously provides a filter that can retain a desirable level of hardness even when the removable tipping wrapper portion has been removed.

In certain embodiments, the plug wrap may extend downstream of the mouthpiece segments to define a mouth end recess. In such embodiments, the use of a plug wrap having a relatively high basis weight as defined above advantageously helps to retain the structure of the recess during smoking.

In some embodiments the aerosol generating article further comprises a combining wrapper circumscribing at least a portion of each of the mouthpiece and the aerosol generating substrate to secure the mouthpiece to the aerosol generating substrate. In such embodiments, the upstream tipping wrapper portion may be attached only to a portion of the combining wrapper overlying the mouthpiece. Alternatively, the upstream tipping wrapper portion may be attached only to a portion of the combining wrapper overlying the aerosol generating substrate. In some embodiments, the upstream tipping wrapper portion is attached to a portion of the combining wrapper overlying the mouthpiece and a portion of the combining wrapper overlying the aerosol generating substrate.

Alternatively, the aerosol generating article may not comprise a separate combining wrapper and the tipping wrapper itself may be used to secure the mouthpiece to the aerosol generating substrate. In such embodiments, the aerosol generating article may further comprise an aerosol generating substrate wrapper wrapped around at least a portion of the aerosol generating substrate, wherein the upstream tipping wrapper portion is attached to a downstream portion of the aerosol generating substrate wrapper and an upstream portion of the mouthpiece.

The outer surface of the mouthpiece wrapper may be provided with text or graphics that are revealed to the consumer when the removable tipping wrapper portion is removed by the consumer during use. For example, the outer surface of the mouthpiece wrapper may be printed with inks to provide an aesthetic feature underneath the removable tipping wrapper portion.

In certain embodiments of the invention, at least one flavourant may be provided between the removable tipping wrapper portion and the underlying mouthpiece portion. As used herein, the term "flavourant" is used to describe a material that can be used to deliver at least one of a gustatory sensation and an olfactory sensation to the consumer. By providing a flavourant underneath the removable tipping wrapper portion, a consumer is provided with control over when the flavourant is delivered. Suitable flavourants for incorporation into aerosol generating articles would be known to the skilled person.

The at least one flavourant may be provided on a surface of the removable tipping wrapper portion facing the underlying mouthpiece portion, on the surface of the underlying mouthpiece portion, or both. The at least one flavourant may be deposited as a coating, or may be impregnated into the surface of the removable tipping wrapper portion or mouthpiece portion. The at least one flavourant may be encapsulated, for example, contained within a plurality of microcapsules, to reduce or prevent migration of the flavourant.

Alternatively or in addition to the provision of a flavourant between the removable tipping wrapper portion and the underlying mouthpiece portion, the mouthpiece may comprise at least one surface formation underlying the removable tipping wrapper portion. As used herein, the term "surface formation" describes a variation in a surface of the mouthpiece that results in the surface being non-uniform. By providing at least one surface formation on the surface of the mouthpiece underlying the removable tipping wrapper portion, a consumer is provided with a choice over the surface texture of the aerosol generating article that contacts their lips during smoking or otherwise using the aerosol generating article.

The mouthpiece may comprise a mouthpiece wrapper, as described above, wherein the mouthpiece wrapper comprises the at least one surface formation. The at least one surface formation may comprise at least one of an embossment and a debossment. Alternatively or in addition, the at least one surface formation may comprise a variation in the thickness of the mouthpiece wrapper. Alternatively or in addition, the at least one surface formation may comprise one or more materials deposited or otherwise provided on a surface of the mouthpiece wrapper, for example, at least one of an ink or varnish.

Aerosol generating articles according to the present invention may be filter cigarettes or other smoking articles in which the aerosol generating substrate comprises a tobacco material that is combusted to form smoke. Therefore, in any of the embodiments described above, the aerosol generating substrate may comprise a tobacco rod.

Alternatively, aerosol generating articles according to the present invention may be articles in which a tobacco material is heated to form an aerosol, rather than combusted. In one type of heated aerosol generating article, a tobacco material is heated by one or more electrical heating elements to produce an aerosol. In another type of heated aerosol generating article, an aerosol is produced by the transfer of heat from a combustible or chemical heat source to a physically separate tobacco material, which may be located within, around or downstream of the heat source. The present invention further encompasses aerosol generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
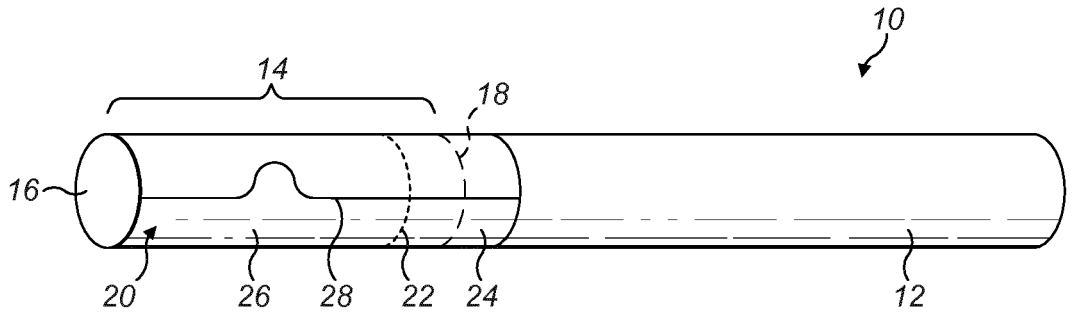
FIG. 1 shows a perspective view of an aerosol generating article in accordance with a first embodiment of the present invention.

FIG. 1 shows an aerosol generating article 10 according to a first embodiment of the present invention. The aerosol generating article 10 is a filter cigarette comprising an aerosol-generating substrate 12 in the form of a wrapped tobacco rod and a mouthpiece 14 comprising a single segment of filtration material 16 axially aligned with the tobacco rod. A downstream end of the tobacco rod abuts an upstream end of the mouthpiece 14 along the line 18 shown in FIG. 1.

A tipping wrapper 20 comprising a row of perforations that form a weakening line 22 is wrapped around the mouthpiece 14 and a portion of the tobacco rod so that an upstream tipping wrapper portion 24 extends upstream from the weakening line 22, and a removable tipping wrapper portion 26 extends downstream from the weakening line 22. Only the upstream tipping wrapper portion 24 is glued to the underlying portions of the tobacco rod and the mouthpiece 14. The removable tipping wrapper portion 26 is not glued to the underlying mouthpiece 14 and is secured to the aerosol generating article 10 only along the weakening line 22 where it is secured to the upstream tipping wrapper portion 24.

The longitudinal edge 28 of the tipping wrapper 20 forms a seam extending in a longitudinal direction along the mouthpiece 14. The longitudinal edge 28 comprises a tipping wrapper projection 32 at a distance downstream of the first weakening line 22 and a first straight line portion 30 extending upstream from the tipping wrapper projection 32 to the upstream end of the tipping wrapper 20. The tipping wrapper projection 32 defines a curved tear tab 34. The longitudinal edge 28 further comprises a second straight line portion 36 extending downstream from the tipping wrapper projection 32 to the downstream end of the tipping wrapper 20. The first straight line portion 30 and the second straight line portion 36 are in line with each other, at the same position around the circumference of the mouthpiece 14.

Figure 2:
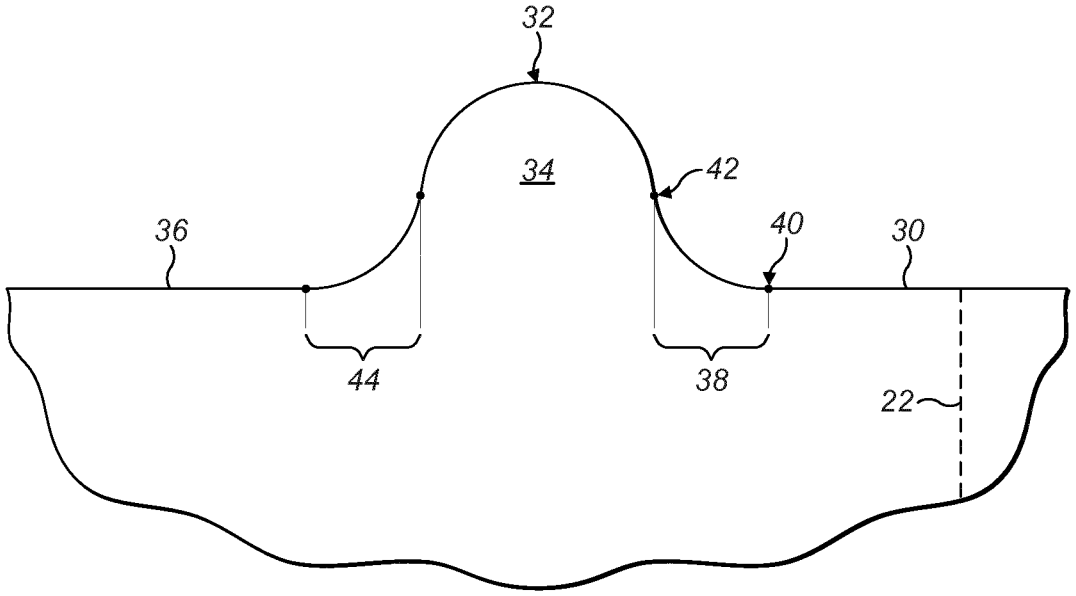
FIG. 2 shows an enlarged view of the tipping wrapper projection of the tipping wrapper of the aerosol generating article of FIG. 1.

As can be seen in the enlarged view of FIG. 2, the tipping wrapper projection 32 is in the form of a symmetric bell-shaped curve. The curve is a smooth, continuous curve such that every point on the curve has a unique tangent line. The tipping wrapper projection 32 comprises a first curved transition portion 38 connecting the first straight line portion 30 of the longitudinal edge to the remainder of the tipping wrapper projection 32. The first curved transition portion 38 is convexly curved. As shown in FIG. 2, the upstream end 40 of the first curved transition portion 38 is defined at the position where the longitudinal edge 28 begins to curve away from the first straight line portion 30. The downstream end 42 is defined as the point of inflection in the tipping wrapper projection 32 curve, where the curvature of the tipping wrapper projection 38 changes from convex to concave.

The tipping wrapper projection 32 further comprises a second curved transition portion 44 which connects the second straight line portion 36 to the remainder of the tipping wrapper projection 30. The second curved transition portion 44 has a corresponding shape to the first curved transition portion 38 due to the symmetric shape of the tipping wrapper projection 32.

Before, during or after smoking the aerosol generating article 10, the consumer can remove the removable tipping wrapper portion 26, if desired, to expose the underlying portion of the mouthpiece 14. To remove the removable tipping wrapper portion 26 the consumer can grasp the tear tab 34 on the removable tipping wrapper portion 26 and can then peel the removable tipping wrapper portion 26 away from the mouthpiece 14 by breaking the row of perforations forming the weakening line 22. The curved shape of the first transition region 38 of the tipping wrapper projection 32 minimises the risk of potential points of weakness existing in the region of the longitudinal edge where the tipping wrapper projection 32 meets the first straight line portion 30. This enables the force applied by the consumer to be more effectively transmitted to the weakening line 22 such that the removable tipping wrapper portion 26 can be removed in a single piece, without tearing of the tipping wrapper away from the weakening line 22.

Figure 3:
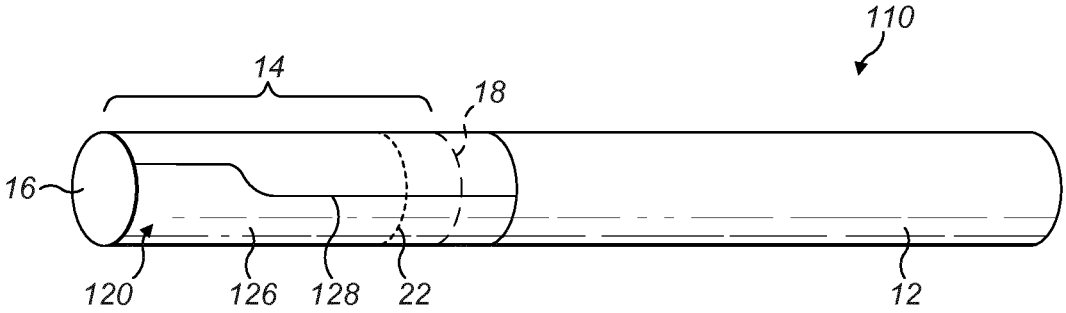
FIG. 3 shows a perspective view of an aerosol generating article in accordance with a second embodiment of the present invention.

FIG. 3 shows an aerosol generating article 40 according to a second embodiment of the present invention. The aerosol generating article 40 is a filter cigarette of similar construction to the aerosol generating article 10 shown in FIGS. 1 and 2, and therefore like reference numerals are used to designate like parts.

Figure 4:
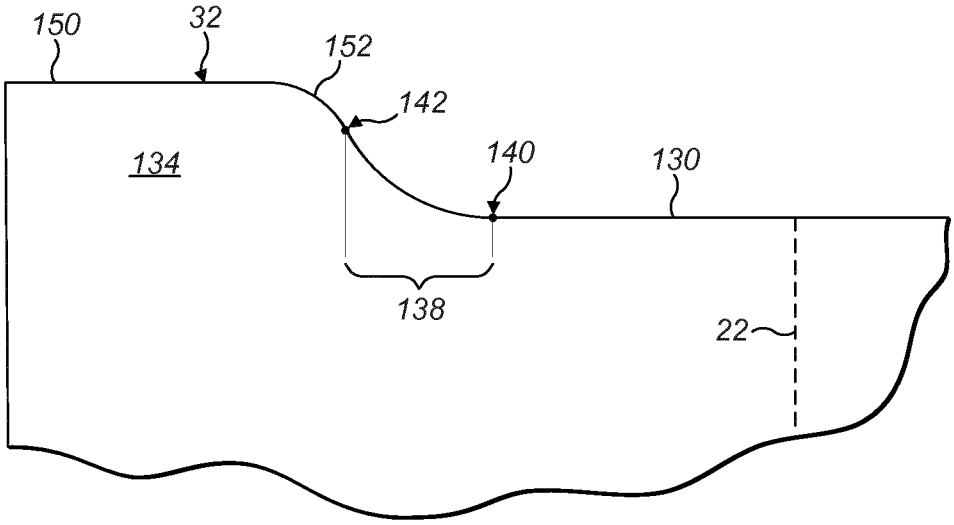
FIG. 4 shows an enlarged view of the tipping wrapper projection of the tipping wrapper of the aerosol generating article of FIG. 3.

The aerosol generating article 110 shown in FIG. 3 differs from the aerosol generating article 10 shown in FIG. 1 in the shape of the tear tab at the longitudinal edge of the tipping wrapper 120. Specifically, as shown in FIG. 4, the longitudinal edge 128 of the tipping wrapper 120 of the aerosol generating article 110 comprises a tipping wrapper projection 132 having an asymmetric shape. The tipping wrapper projection 132 comprises a first curved transition portion 138 connecting the first straight line portion 130 of the longitudinal edge 128 to the remainder of the tipping wrapper projection 132 and a linear portion 150 extending downstream from the first curved transition portion 138 to the downstream edge of the tipping wrapper 120. The linear portion 150 extends along the mouthpiece 14 in a longitudinal direction and is offset from the first straight line portion 130 of the longitudinal edge to form an elongate tear tab 134. The first curved transition portion 138 and the linear portion 150 are connected by a rounded corner 152.

The first curved transition portion 138 has a convex shape which corresponds to that described above with reference to the embodiment shown in FIGS. 1 and 2. The upstream 140 and downstream 142 ends of the first curved transition portion 138 are defined in an analogous way. However, the tipping wrapper projection 132 is shaped such that instead of curving back towards the longitudinal edge to form a symmetric bell-shaped curve as in the first embodiment shown in FIGS. 1 and 2, the tipping wrapper projection 132 curves back around at the rounded corner 152 and then extends in a straight line to define the linear portion 150.

As with the aerosol generating article 10 shown in FIGS. 1 and 2, the consumer can use the tear tab 136 to remove the removable tipping wrapper portion 126 of the aerosol generating article 120 before, during or after smoking, to expose the underlying portion of the mouthpiece 14.

The invention claimed is:

1. An aerosol generating article comprising:

an aerosol generating substrate;

a mouthpiece in axial alignment with the aerosol generating substrate;

a tipping wrapper wrapped around the mouthpiece and at least a portion of the aerosol generating substrate, the tipping wrapper comprising:

a first weakening line extending circumferentially around at least a portion of the tipping wrapper;

a removable tipping wrapper portion extending downstream from the at least one weakening line;

an upstream tipping wrapper portion extending upstream from the first weakening line, wherein the upstream tipping wrapper portion is attached to a downstream portion of the aerosol generating substrate and an upstream portion of the mouthpiece; and a longitudinal edge extending along the outer surface of the mouthpiece, the longitudinal edge comprising a tipping wrapper projection between 5-10 mm downstream of the first weakening line on the removable tipping wrapper portion and a first straight line portion of the longitudinal edge extending upstream from the tipping wrapper projection, wherein the tipping wrapper projection comprises a first curved transition portion of the longitudinal edge connecting the first straight line portion of the longitudinal edge to the remainder of the tipping wrapper projection and wherein the first curved transition portion follows a convex curve.

2. The aerosol generating article according to claim 1 wherein the radius of curvature is at least 0.5 mm along the length of the first curved transition portion.

3. The aerosol generating article according to claim 1, wherein the tipping wrapper projection extends between 2.0 mm and 5.0 mm beyond the first straight line portion of the longitudinal edge, in a circumferential direction.

4. The aerosol generating article according to claim 1, wherein at least a portion of the first straight line portion extends downstream of the first weakening line.

5. The aerosol generating article according to claim 1, wherein the width of the first curved transition portion in the longitudinal direction corresponds to at least 10 percent of the distance of the tipping wrapper projection from the first weakening line.

6. The aerosol generating article according to claim 1, wherein the longitudinal edge of the tipping wrapper further comprises a second straight line portion extending downstream from the tipping wrapper projection to the downstream end of the removable tipping wrapper portion and wherein the tipping wrapper projection further comprises a second curved transition portion connecting the second straight line portion of the longitudinal edge to the remainder of the tipping wrapper projection, wherein the second curved transition portion is convex.

7. The aerosol generating article according to claim 1, wherein the tipping wrapper further comprises:

a second weakening line spaced apart from the first weakening line in a downstream direction, wherein the removable tipping wrapper portion extends between the first weakening line and the second weakening line; and a downstream tipping wrapper portion extending downstream from the second weakening line and attached to a downstream portion of the mouthpiece.

8. The aerosol generating article according to claim 1, wherein the tipping wrapper projection is a continuous, smooth curve.

9. The aerosol generating article according to claim 8 wherein the tipping wrapper projection is a Gaussian-like curve.

10. The aerosol generating article according to claim 1, wherein the tipping wrapper projection comprises a linear portion downstream of the first curved transition portion, wherein the linear portion extends to the downstream edge of the removable tipping wrapper portion.

11. The aerosol generating article according to claim 1, wherein the removable tipping wrapper portion extends to the downstream edge of the tipping wrapper.

12. The aerosol generating article according to claim 1, wherein the weakening line comprises a row of perforations extending around the tipping wrapper, wherein the row of perforations has a percentage of hold of between 15 percent and 30 percent.

13. The aerosol generating article according to claim 1, wherein the mouthpiece is circumscribed by a mouthpiece wrapper comprising one or more plug wraps, the one or more plug wraps having a basis weight of between 50 grams per square metre and 100 grams per square metre.

14. The aerosol generating article according to claim 13 wherein the one or more plug wraps extend beyond the downstream end of the mouthpiece to define a mouth end recess.

* * * * *